US009085928B2

(12) United States Patent
Yeremian

(10) Patent No.: US 9,085,928 B2
(45) Date of Patent: Jul. 21, 2015

(54) REINFORCED DOOR ASSEMBLY AND METHOD OF MAKING THE SAME

(71) Applicant: Noubar Yeremian, Radnor, PA (US)

(72) Inventor: Noubar Yeremian, Radnor, PA (US)

( * ) Notice: Subject to any disclaimer, the term of this patent is extended or adjusted under 35 U.S.C. 154(b) by 0 days.

(21) Appl. No.: 14/097,392

(22) Filed: Dec. 5, 2013

(65) Prior Publication Data

US 2014/0165886 A1 Jun. 19, 2014

Related U.S. Application Data

(60) Provisional application No. 61/737,193, filed on Dec. 14, 2012.

(51) Int. Cl.
*E06B 3/00* (2006.01)
*E06B 5/11* (2006.01)
*E06B 3/88* (2006.01)

(52) U.S. Cl.
CPC ... *E06B 5/11* (2013.01); *E06B 3/88* (2013.01); *E06B 5/113* (2013.01)

(58) Field of Classification Search
CPC ... E05Y 2201/238; E06B 5/11; E06B 3/5842; E06B 3/725; E06B 17/2084
USPC ..... 70/417, 450, 451; 109/64, 74–76, 78, 109/79, 82–84; 49/460, 506; 52/126.3, 213, 52/204.1, 656.2, 656.4
See application file for complete search history.

(56) References Cited

U.S. PATENT DOCUMENTS

| | | | | | |
|---|---|---|---|---|---|
| 2,070,219 | A * | 2/1937 | Tracy | 52/784.1 |
| 4,635,399 | A | 1/1987 | Gehrke et al. | |
| 4,717,185 | A | 1/1988 | Hartley | |
| 4,831,804 | A * | 5/1989 | Sayer | 52/475.1 |
| 5,070,650 | A * | 12/1991 | Anderson | 49/460 |
| 5,241,790 | A * | 9/1993 | Schimpf | 49/504 |
| 5,290,077 | A | 3/1994 | Fleming | |
| 5,339,522 | A * | 8/1994 | Paquin et al. | 29/897.312 |
| 5,557,899 | A * | 9/1996 | Dube et al. | 52/455 |
| 5,836,628 | A * | 11/1998 | Beier | 292/346 |
| 5,887,398 | A * | 3/1999 | Chen | 52/309.9 |
| 6,062,293 | A * | 5/2000 | Berger, Jr. | 160/229.1 |
| 6,082,049 | A * | 7/2000 | Hudson | 49/460 |
| 6,185,894 | B1 * | 2/2001 | Sisco et al. | 52/457 |
| 6,598,350 | B1 * | 7/2003 | Suter | 49/506 |
| 6,622,449 | B2 * | 9/2003 | Smith et al. | 52/656.9 |
| 6,679,019 | B2 * | 1/2004 | Rochman | 52/455 |
| 6,691,466 | B2 * | 2/2004 | Childress | 49/462 |
| 7,165,793 | B2 | 1/2007 | Richmond et al. | |
| 7,866,113 | B2 * | 1/2011 | Young | 52/656.4 |
| 2002/0174612 | A1 * | 11/2002 | Camperelli | 52/210 |
| 2003/0029093 | A1 * | 2/2003 | Childress | 49/462 |
| 2003/0159361 | A1 | 8/2003 | Yeremian | |
| 2005/0011132 | A1 * | 1/2005 | Griffin, Jr. | 49/460 |
| 2005/0210797 | A1 * | 9/2005 | Hees | 52/455 |
| 2006/0101735 | A1 * | 5/2006 | Silverman | 52/204.1 |
| 2008/0224486 | A1 * | 9/2008 | Anderson | 292/340 |
| 2009/0133343 | A1 * | 5/2009 | Tedder | 52/204.1 |
| 2012/0085045 | A1 * | 4/2012 | Torres | 52/204.1 |

* cited by examiner

*Primary Examiner* — Suzanne Barrett
(74) *Attorney, Agent, or Firm* — RatnerPrestia

(57) ABSTRACT

A reinforced door assembly and method of manufacture wherein the assembly includes at least two stiles, an upper rail, and a lower rail, wherein the at least two stiles, upper rail, and lower rail are arranged in a rectangular frame; and wherein at least one of the two stiles includes a vertical section, an edge section that is parallel to the vertical section, and a reinforcing bar located between the vertical section and the edge section. The reinforcing bar spans at least a portion of the height of the frame and prevents forced entry.

16 Claims, 2 Drawing Sheets

REINFORCED DOOR ASSEMBLY AND METHOD OF MAKING THE SAME

CROSS-REFERENCE TO RELATED APPLICATION

This application claims priority of U.S. Provisional Application No. 61/737,193, filed Dec. 14, 2012, the disclosure of which is incorporated herein by reference in its entirety for all purposes.

FIELD OF THE INVENTION

The invention relates to a security feature for a door to prevent forced entry.

BACKGROUND OF THE INVENTION

Current doors may be made of hardwood around the periphery of the door; but the hardwood often does not provide sufficient resistance to forced entries that occur during burglaries or acts of vandalism. During such acts, force is generally applied around the lock by pushing or kicking in the door to force the lock-side of the door to bend, warp, or break. There is therefore a need for improved door assemblies which can resist forced entry.

SUMMARY OF THE INVENTION

According to one embodiment of the present invention, a reinforced door assembly comprises at least two stiles, an upper rail, and a lower rail. The at least two stiles, upper rail, and lower rail are arranged in a rectangular frame. Also, at least one of the two stiles comprises a vertical section, an edge section that is generally parallel to the vertical section, and a reinforcing bar located between the vertical section and the edge section.

According to another embodiment of the present invention, a method of making a reinforced door assembly comprises forming a rectangular frame comprising at least two stiles, an upper rail, and a lower rail. The first stile is made by joining a vertical piece, an edge piece, and a reinforcing bar by inserting the reinforcing bar between the vertical piece and the edge piece. The upper rail is joined between the first stile and a second stile edge in proximity to a top surface of the first and second stiles, and the lower rail is joined between the first and second stiles and in proximity to a bottom surface of the first and second stiles. At least one outer skin is applied to each of a first and second surface of the rectangular frame, wherein the first and second surfaces are in opposing relation.

BRIEF DESCRIPTION OF THE FIGURES

In order that the invention may be more fully understood, the following figures are provided by way of illustration, in which.

DETAILED DESCRIPTION

Figure 1:
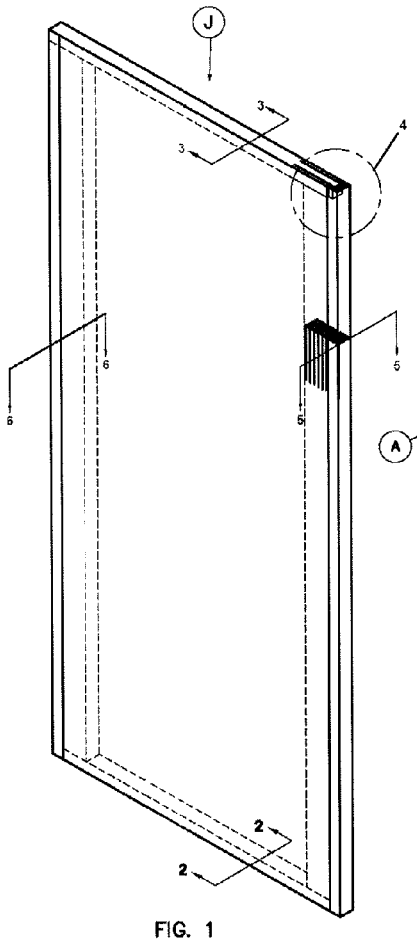
FIG. 1 is a front perspective view of a door assembly according to one embodiment of the present invention.
Figure 4:
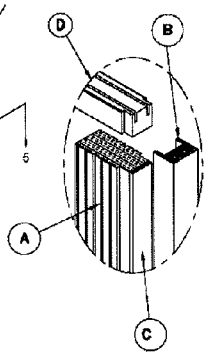
FIG. 4 is an exploded view of the corner 4 of the embodiment illustrated in FIG. 1.

Although the invention is illustrated and described herein with reference to specific embodiments, the invention is not intended to be limited to the details shown. Rather, various modifications may be made in the details within the scope and range of equivalents of the claims and without departing from the invention.

One embodiment of the present invention provides improved security to a door by reinforcing the frame of the door assembly, preferably along the lock-side. To "reinforce" as used herein throughout the specification and the claims means to prevent bending, warping, and/or breaking of the door during a forced entry when an excessive amount of force is applied in a direction which is generally perpendicular to the orientation of the door.

Another embodiment of the invention provides a door assembly that includes a reinforcing bar that spans at least a portion of the height of the door, preferably on the lock-side, to reinforce the door and prevent forced entry.

Yet another embodiment of the invention provides a method of making a door assembly that includes a reinforcing bar.

Referring to FIGS. 1 through 6, wherein like reference numerals and letters refer to like elements, a first embodiment of the present invention is illustrated. Specifically with reference to FIGS. 1 and 4-6, a generally rectangular door frame J comprises two generally parallel stiles along the hinge-side and lock-side of the door assembly J and two generally parallel horizontal rails. Each stile includes an edge section B located on the outer periphery of the frame J and a vertical section A. The edge section B may include a U-shaped channel which forms the female portion of a joint into which a finger joint extending from the vertical section A is inserted. The edge section B and the vertical section A, like the horizontal edge D, are preferably made of a hardwood, such as pine or maple. In the embodiment illustrated in FIGS. 1-6, both stiles of the door frame include a vertical section A and an edge section B; however, other embodiments of the invention may include only one stile having multiple sections, preferably along the lock-side of the door, while the opposite stile may be a single unitary piece.

Figure 2:
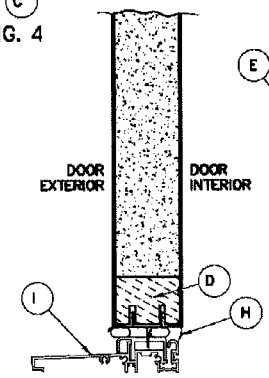
FIG. 2 is a cross-sectional view along axis 2-2 of the embodiment illustrated in FIG. 1.
Figure 3:
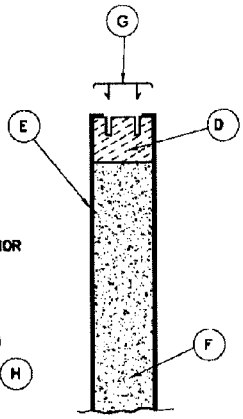
FIG. 3 is a cross-sectional view along axis 3-3 of the embodiment illustrated in FIG. 1.
Figure 10:
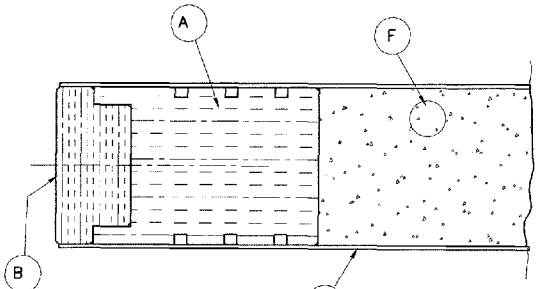
FIG. 10 is a cross-sectional view along axis 10-10 of the embodiment illustrated in FIG. 7.
Figure 9:
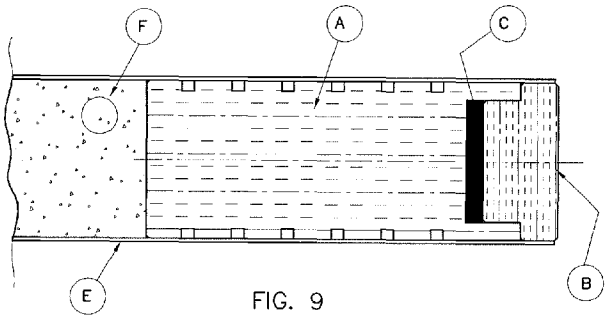
FIG. 9 is a cross-sectional view along axis 9-9 of the embodiment illustrated in FIG. 7.
Figure 8:
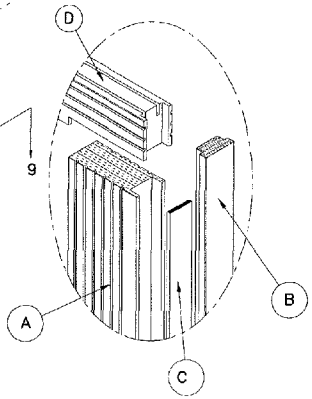
FIG. 8 is an exploded view of the corner 8 of the embodiment illustrated in FIG. 7.
Figure 7:
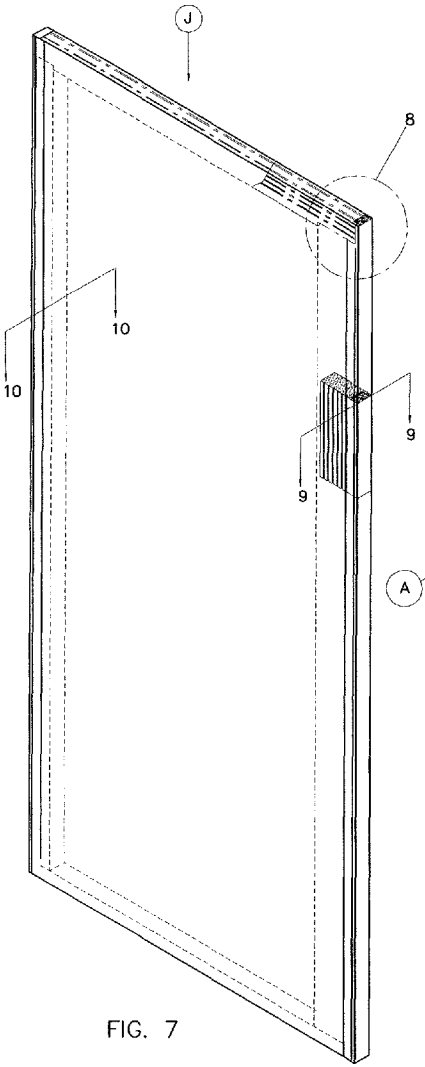
FIG. 7 is a front perspective view of a door assembly according to another embodiment of the present invention.

Now referring to FIGS. 1-3, the door assembly J further comprises an upper and lower rail D. The upper and lower rails D are in contact with a top and bottom surface of the stiles, respectively, and also include a male projection which is inserted into the U-channels of the edge sections B. The upper and lower rails D are preferably made of a hardwood, such as pine. A protective cover G may be applied on an exposed surface of the upper and lower rails. In one embodiment, the protective cover G is applied to the surface by inserting two extensions that extend from the bottom of the cover G into a corresponding groove in the exposed surface of the upper and lower rail. The extensions may be approximately the same length as the cover G and include a flared tip that may be wedged into the grooves in the upper and lower rails. Other means of attaching the protective cover G are known to those having skill in the art, including, but not limited to, the use of fasteners or an adhesive. The protective cover G is preferably made of PVC. The cover G applied to the lower rail D may optionally include a sweep H, such that when the door is in a closed position, the sweep H creates a seal by pressing against the side of a threshold I, as illustrated in FIG. 2.

Figure 6:
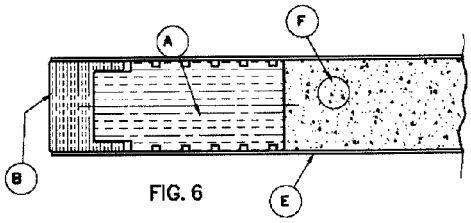
FIG. 6 is a cross-sectional view along axis 6-6 of the embodiment illustrated in FIG. 1.
Figure 5:
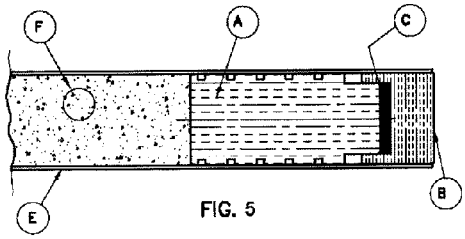
FIG. 5 is a cross-sectional view along axis 5-5 of the embodiment illustrated in FIG. 1.

Referring to FIG. 5, one stile of the door assembly 3 further comprises a flat bar C which is sandwiched between the U-channel of the edge section B and the male portion of the vertical section A. The flat bar C spans at least a portion of the height of the door assembly J, preferably of the same length as the edge section B, and is configured to resist warping when a force is applied to the flat bar C. The reinforcing flat bar C, in order to resist warping, may be made of a strong material and/or have dimensions (e.g., width and thickness) which prevent bending of the bar when a force is applied in a generally perpendicular direction to the vertical axis of the bar. Preferably, the flat bar is a 3/16" steel bar and is installed such that the width of the flat bar is flush against the bottom of the U-channel. The hinge-side stile of the door assembly as illustrated in FIG. 6 does not include a flat bar C. A flat bar C may be installed on the hinge-side of the door; however, an intruder or vandal is more likely to be apply force to the lock-side of the door assembly because a person is unlikely capable of generating the requisite force needed to swing-open a locked door by ramming or kicking the hinge-side of the door.

In an alternative embodiment of the present invention, a door assembly J is illustrated in FIGS. 7-10 in which the edge section B is provided with the male portion of the joint and the stiles A and upper and lower rails D include the U-channel forming the female portion of the joint.

When assembled, the vertical sections, edge sections, flat bar, upper rail and lower rail preferably form a rectangular frame. The door assembly J further comprises an outer skin E applied to opposite sides of the frame. The outer skin E may provide various features to the door assembly, for example, the outer skin E may be dent or fade resistant. The outer skin is preferably made of fiberglass and may include a graphic on the exterior surface to simulate the appearance of a wood grain. Alternatively, the outer skin E may be provided in various colors or painted.

Upon applying the outer skin to the interior and exterior surface of the frame, a hollow core is formed. In order to improve the insulating properties of the door, the hollow core may be filled with an insulating material. The insulating material is preferably a polyurethane foam which may be injected into the hollow core.

The present invention also includes a method of making a reinforced door assembly. The method comprises forming a rectangular frame and applying at least one outer skin to each of a first and second surface of the rectangular frame, wherein the first and second surfaces are in opposing relation. The frame may be made by joining a vertical piece, an edge piece, and a reinforcing bar by inserting the reinforcing bar between the vertical piece and the edge piece to form a first stile; joining an upper rail between the first stile and a second stile in proximity to a top surface of the first and second stiles; and joining a lower rail between the first and second stiles in proximity to a bottom surface of the first and second stiles. The method may also optionally include filing the internal space or void within the door assembly with an insulating material. Preferably, the insulating material is in the form of foam and injected into the inner space of the door assembly after the frame is formed and the exterior skin is affixed to the frame. The method may also optionally include the step of incorporating a lockset or at least an opening that can accommodate a lockset in the first stile, so that the stile which includes the reinforcing bar is on the lock-side of the door assembly.

The stiles, rails, and outer skin may be fastened to each other to form the frame using various methods known in the art. Preferably an adhesive is used to fasten the various components of the reinforced door assembly together. For example, one or more of the components may include a plurality of grooves on a surface which contacts another element of the frame. The grooves provide additional surface area and voids in which adhesive may be filled, such as the grooves illustrated in the vertical sections A illustrated in FIGS. 4-10 or the grooves illustrated in the upper rail D in FIG. 8.

While a preferred embodiment of the invention has been shown and described herein, it will be understood that such embodiment is provided by way of example only. Numerous variations, changes, and substitutions will occur to those skilled in the art without departing from the spirit of the invention. Accordingly, it is intended that the appended claim covers all such variations as fall within the spirit and scope of the invention.

The invention claimed is:

1. A reinforced door assembly comprising at least two stiles, an upper rail, and a lower rail, wherein the at least two stiles, upper rail, and lower rail are arranged in a rectangular frame;

wherein at least one of the two stiles comprises a vertical section, an edge section, and a reinforcing bar, and wherein the edge section has a male projection and the vertical section has a U-channel or the section has the U-channel and the vertical section has the male projection, the reinforcing bar and male projection are located within the U-channel the male projection is adjacent to the reinforcing bar and the U-cannel.

2. The reinforced door assembly of claim 1, wherein the reinforcing bar is configured to resist warping when a force is applied to the reinforcing bar.

3. The reinforced door assembly of claim 1, wherein the rectangular frame has a height and the reinforcing bar extends vertically for at least a portion of the height.

4. The reinforced door assembly of claim 3, wherein the reinforcing bar extends vertically along the entire height.

5. The reinforced door assembly of claim 1, wherein the rectangular frame has a hinge-side and a lock-side, and the reinforcing bar is located on the lock-side.

6. The reinforced door assembly of claim 1, wherein the vertical section includes the male projection and the edge section includes the U-channel.

7. The reinforced door assembly of claim 1, wherein the edge section includes the male projection and the vertical section includes the U-channel.

8. The reinforced door assembly of claim 1 further comprising an outer skin applied to at least two surfaces of the rectangular frame, wherein an inner core is formed having a volume bounded by the outer skin, the at least two stiles, the upper rail, and the lower rail.

9. The reinforced door assembly of c aim 8, wherein the inner core contains insulating material.

10. The reinforced door assembly of claim 1, wherein a protective cover is applied to a surface of at least one of the upper rail and the lower rail,

11. A method of making a reinforced door assembly comprising a reinforcing bar and an edge piece having a male projection and a vertical piece having a U-channel or the edge piece having the U-channel and the vertical piece having the male projection, the method comprising;

forming a rectangular frame by joining the vertical piece, the edge piece, and a reinforcing bar to form a first stile by inserting the reinforcing bar and the male projection into the U-channel, such that the reinforcing bar the male projection is within the U-channel and the male projection is adjacent to the reinforcing bar the U-channel;

joining an upper rail between the first stile and a second stile in proximity to a top surface of the first and second stiles; and joining a lower rail between the first and second stiles in proximity to a bottom surface of the first and second stiles; and applying at least one outer skin to each of a first and second surface of the rectangular frame, wherein the first and second surfaces are in opposing relation.

12. The method of claim 11 further comprising filling a space bounded by the frame and the at least one outer skin with an insulating material.

13. The method of claim 11, wherein the vertical piece includes the male projection and the edge piece includes the U-channel.

14. The method of claim 11, wherein the vertical piece includes the U-channel and the edge piece includes the male projection.

15. The reinforced door assembly of claim 1, wherein the reinforcing bar comprises steel.

16. The method of claim 11, wherein the reinforcing bar comprises steel.

* * * * *